US007361047B2

(12) United States Patent
Strahl

(10) Patent No.: US 7,361,047 B2
(45) Date of Patent: Apr. 22, 2008

(54) REPLACEMENT DEPRESSIBLE TAB FOR MODULAR TELECOMMUNICATIONS PLUG

(76) Inventor: Michael Strahl, 1202 City Pl., Edgewater, NJ (US) 07020

( * ) Notice: Subject to any disclaimer, the term of this patent is extended or adjusted under 35 U.S.C. 154(b) by 0 days.

(21) Appl. No.: 11/514,530

(22) Filed: Sep. 1, 2006

(65) Prior Publication Data

US 2008/0057771 A1 Mar. 6, 2008

(51) Int. Cl.
*H01R 13/627* (2006.01)

(52) U.S. Cl. ..... 439/354

(58) Field of Classification Search ..... 439/354, 439/638, 353, 676, 357, 595
See application file for complete search history.

(56) References Cited

U.S. PATENT DOCUMENTS

| | | | | |
|---|---|---|---|---|
| 4,160,575 | A | 7/1979 | Schraut | |
| 4,607,905 | A | 8/1986 | Vaden | |
| 5,186,649 | A | 2/1993 | Fortner et al. | |
| 5,346,405 | A | 9/1994 | Mosser et al. | |
| 6,116,939 | A | 9/2000 | Fukuda | |
| 6,283,768 | B1 | 9/2001 | Van Naarden | |
| 6,350,157 | B1 | 2/2002 | Mizusawa | |
| 6,796,806 | B2 | 9/2004 | Boutros et al. | |
| 6,846,197 | B2 | 1/2005 | Hirokawa et al. | |
| 6,890,197 | B2 | 5/2005 | Liebenow | |
| 6,918,782 | B2 | 7/2005 | Foster | |
| 6,957,984 | B1 | 10/2005 | Huang | |
| 7,025,636 | B2 * | 4/2006 | Allen | 439/638 |

* cited by examiner

*Primary Examiner*—J. F. Duverne
(74) *Attorney, Agent, or Firm*—Daniel Kirshner

(57) ABSTRACT

A replacement depressible tab for use on a RJ45 Ethernet connector or other such modular connector when the original depressible tab has broken off. The replacement tab of the present invention is incorporated into a housing having a top wall, two side walls, a partial bottom wall and generally open back. The side walls are cut away in a step-back fashion until they merge with the top wall. At the point of the merger, the top wall forms a tongue to which is attached the replacement depressible tab.

1 Claim, 7 Drawing Sheets

REPLACEMENT DEPRESSIBLE TAB FOR MODULAR TELECOMMUNICATIONS PLUG

FIELD OF THE INVENTION

The present invention relates to modular connectors of the type utilized in telecommunications equipment, and specifically to a replacement depressible tab to be utilized in conjunction with a modular plug when the original depressible tab has broken off.

SUMMARY OF THE INVENTION

The present invention is a replacement depressible tab for use on a RJ45 Ethernet connector or other such modular connector when the original depressible tab has broken off. The replacement tab of the present invention is incorporated into a housing having a top wall, two side walls, a partial bottom wall and generally open back. The side walls are cut away in a step-back fashion until they merge with the top wall. At the point of the merger, the top wall forms a tongue to which is attached the replacement depressible tab. The replacement depressible tab of the present invention is inserted over the cord of the modular connector and pushed forward into place such that the replacement depressible tab is now located in the position of the original, broken-off tab. The modular connector having the replacement tab of the present invention may now be inserted into the modular port in the usual manner thereby securing it therein and completing the electrical connections.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The present invention is a replacement depressible tab and its housing for use on a typical prior art modular plug of the type used in connecting telecommunications equipment. As depicted in the embodiment herein, the replacement depressible tab and housing are sized and configured for use in conjunction with a prior art RJ45 modular plug, commonly known as an Ethernet plug. It will be understood, however, that the present invention replacement tab can be sized and configured for use with any other prior art modular plug that includes a depressible tab. Examples of such other prior art modular plugs include RJ11 and RJ14 plugs utilized in connection with telephone equipment and the like.

Figure 1:
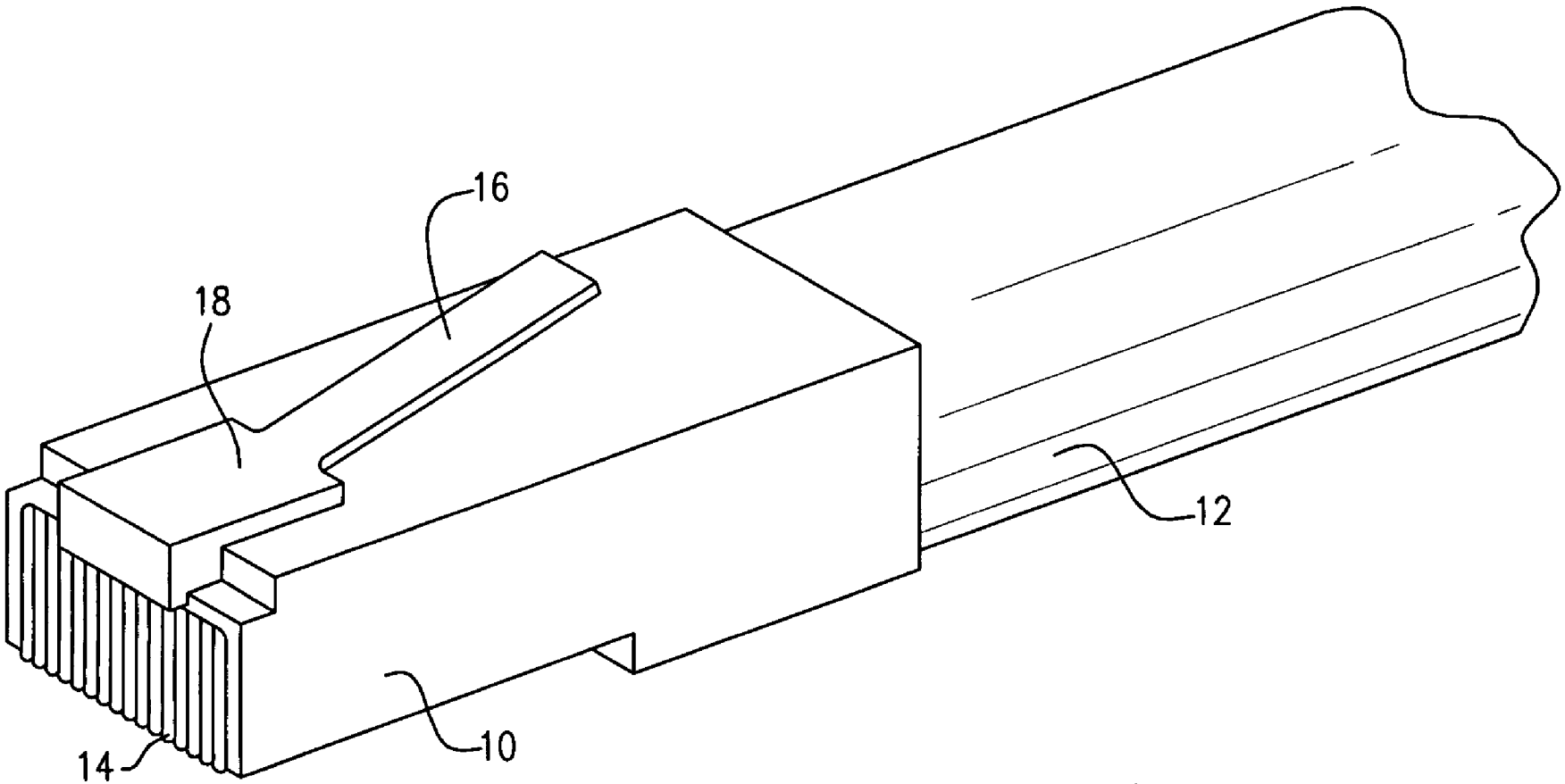
(PRIOR ART) FIG. 1
FIG. 1 is a perspective view of a typical prior art modular telecommunications plug.

A typical prior art modular plug is depicted in FIG. 1. FIG. 1 shows an RJ45 Ethernet connector 10 attached to the telecommunications cable 12 and provides electrical contacts 14 for transmitting electrical signals. These prior art modular plugs include a depressible plastic tab 16. The depressible tab which is also known as a "plug latching bar" hinges at point 18. As such, the depressible tab is compressed downward when inserted into the corresponding female port of the Ethernet connection, and then flexes back into position within the socket in order to lock the modular plug in place in the port. A user can subsequently depress the tab 16 to permit the modular plug to be removed from the port.

Figure 2:
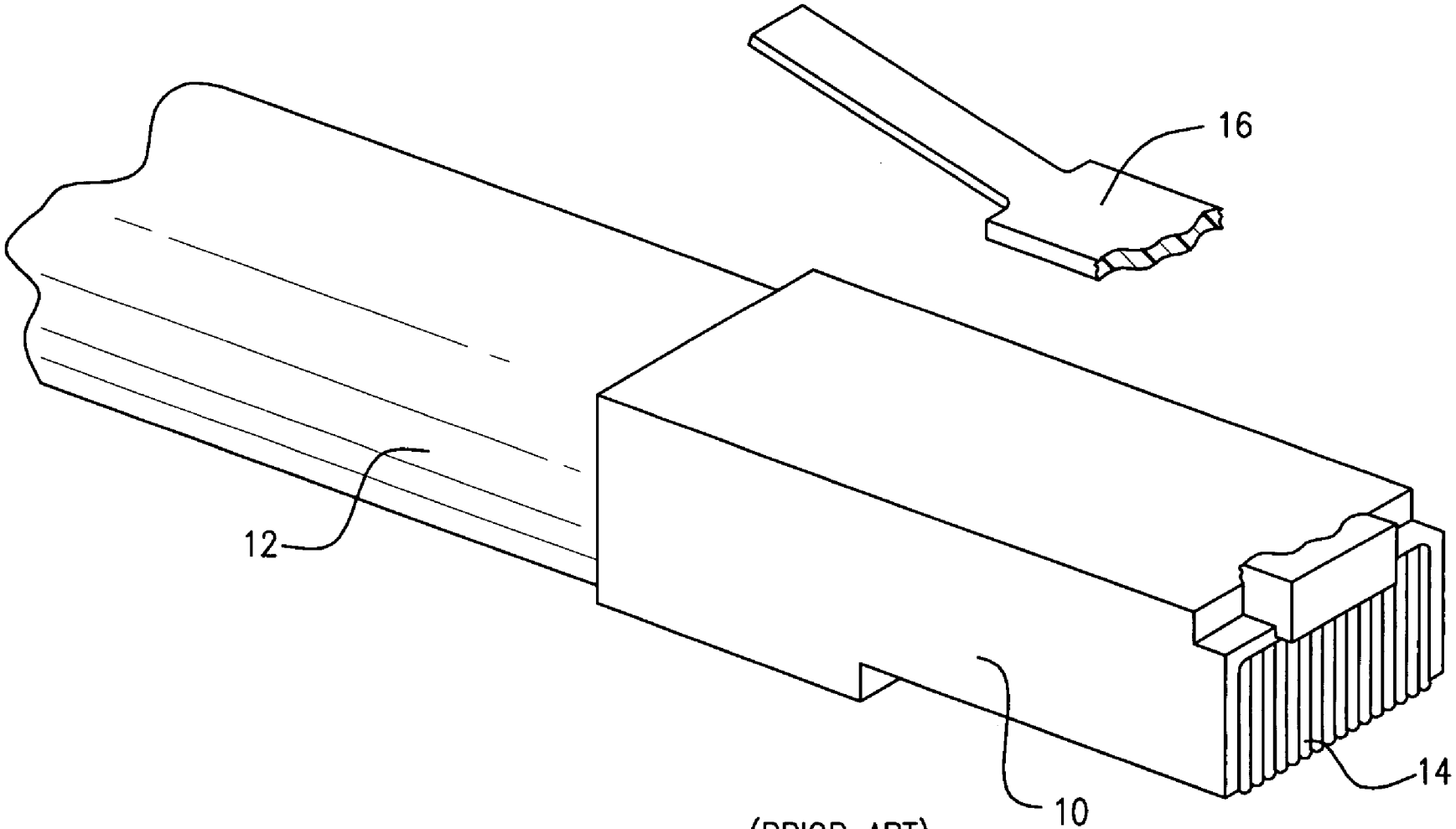
(PRIOR ART) FIG. 2
FIG. 2 is a perspective view of a typical prior art modular telecommunications plug with its depressible tab broken off.

It is common for the prior art depressible tab 16 to break off from the body of the modular plug as depicted in FIG. 2. Once this occurs, the modular plug can no longer be fixed into position in the port thereby compromising the integrity of the electrical connections.

Figure 3:
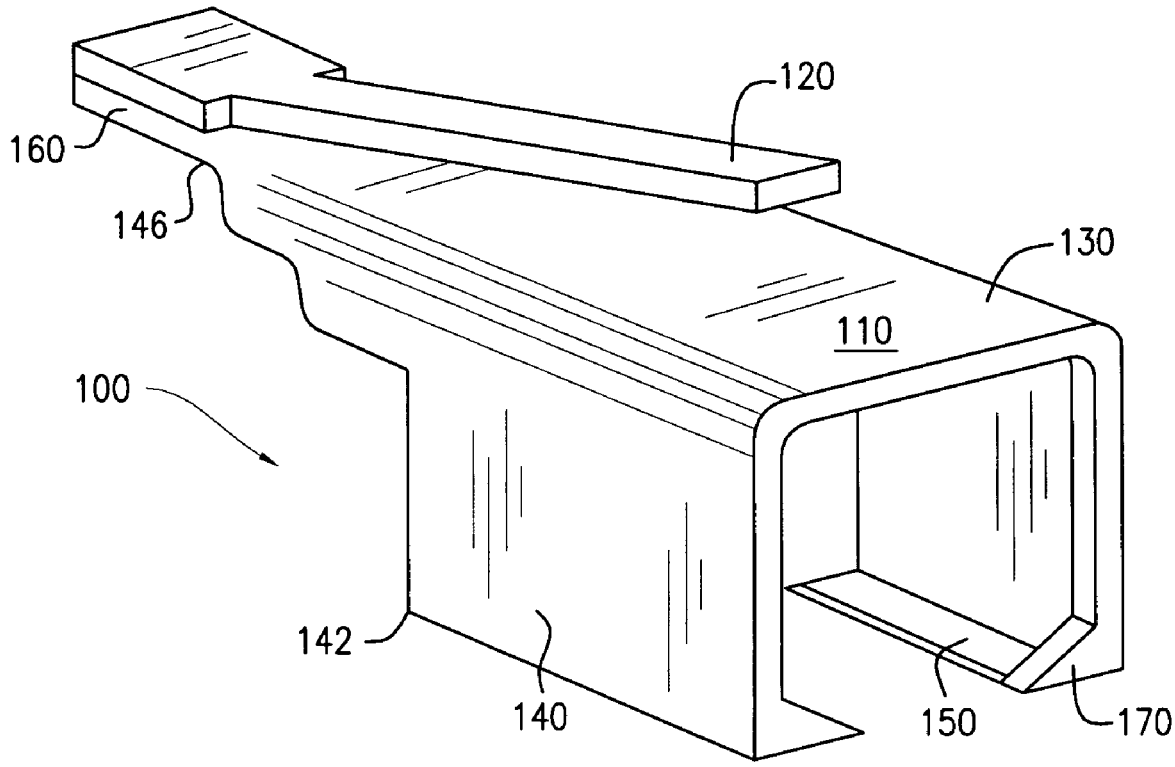
FIG. 3 is a perspective rear view of the present invention replacement tab and housing for use with a modular plug.
Figure 4:
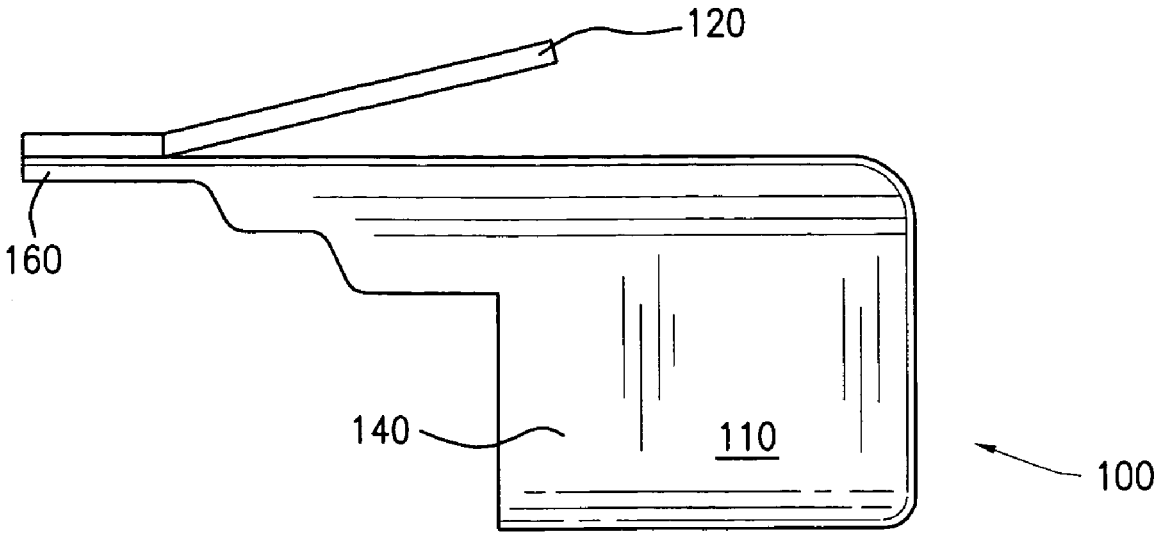
FIG. 4 is a right side elevational view of the present invention replacement tab and housing.
Figure 5:
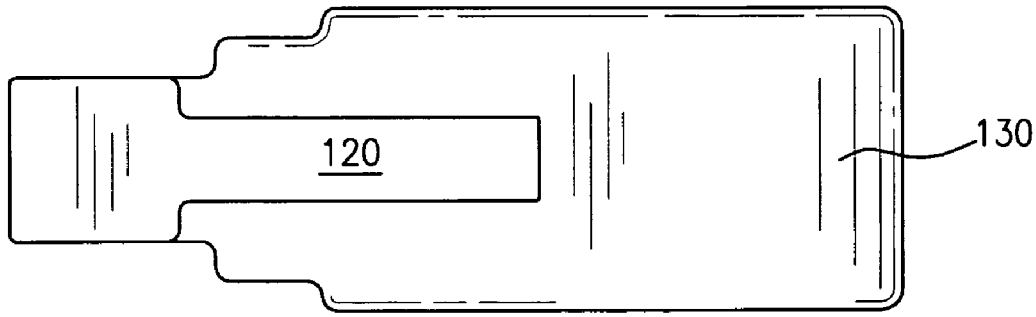
FIG. 5 is a top view of the present invention replacement tab and housing.
Figure 6:
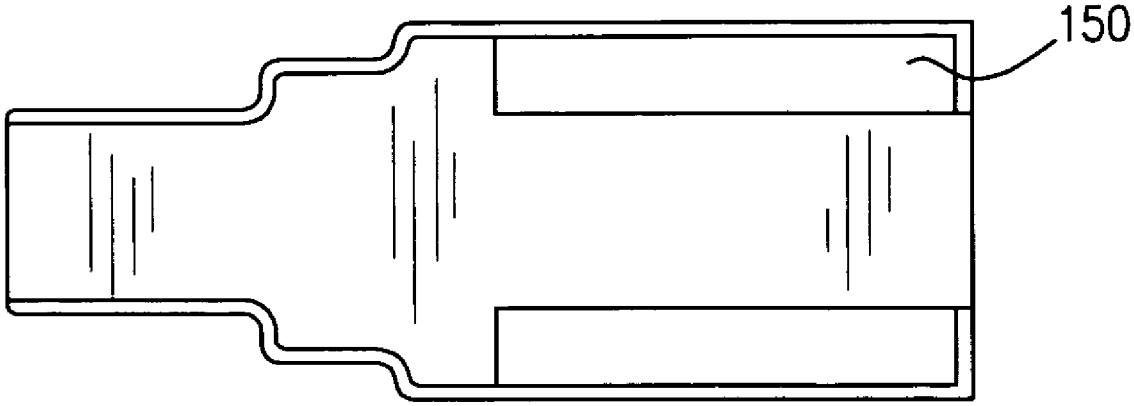
FIG. 6 is a bottom view of the present invention replacement tab and housing.

The present invention replacement tab 100 is depicted in the perspective view of FIG. 3. The replacement tab 100 is utilized to replace the broken-off tab of the prior art modular plug so that the integrity of the electrical connections can be secured.

Generally, the replacement tab 100 of the present invention comprises a housing 110 and a replacement tab 120. The housing and the replacement tab are both formed from lightweight plastic and are properly sized and configured for insertion over the prior art modular plug.

The housing includes a top wall 130, two side walls 140 extending perpendicularly downward from the top wall, and two projections 150 projecting perpendicularly outward from the two side walls along the bottom of the housing.

Looking more closely at the walls of the housing, the top wall 130 extends the full length of the housing wherein the depressible tab 120 is flexibly attached to the front end of the top wall. Now, the two side walls extend downward perpendicularly from the top wall. The two side walls include cutaway portions. Specifically, the side walls step back towards the front of the housing starting at location 142 and continue to step back until at location 146. Here, the side walls converge with the top wall where the top wall forms a tongue 160 extending forward at the front. It will be understood that the configuration, width and thickness of the tongue are chosen so that the tongue and depressible tab may readily be inserted into the appropriate modular port. Furthermore, it is the purpose of the step backs of the side walls to facilitate insertion of the tongue and depressible tab into the modular socket. Specifically, although the housing fits in place over the original modular plug, only the tongue and depressible tab are inserted into the modular port.

Extending outward from the side walls and into the interior portion of the housing are the projections 150 which form a partial bottom wall. The projections extend only partially into the interior of the housing in order to allow the housing to be easily installed over a telecommunications cable. At the back edge of the housing and extending angularly downward from the side walls and into the interior of the housing are the flanges 170 which form a partial back wall of the housing.

The depressible tab 120 is flexibly attached to the tongue 160 near the front of the housing, and extends angularly upward toward the back of the housing. The tab is compressible so that is flexes downward when the replacement tab is inserted into a modular port. Thereafter, upon insertion into the modular port, the depressible tab flexes back upward into its original configuration.

Figure 7:
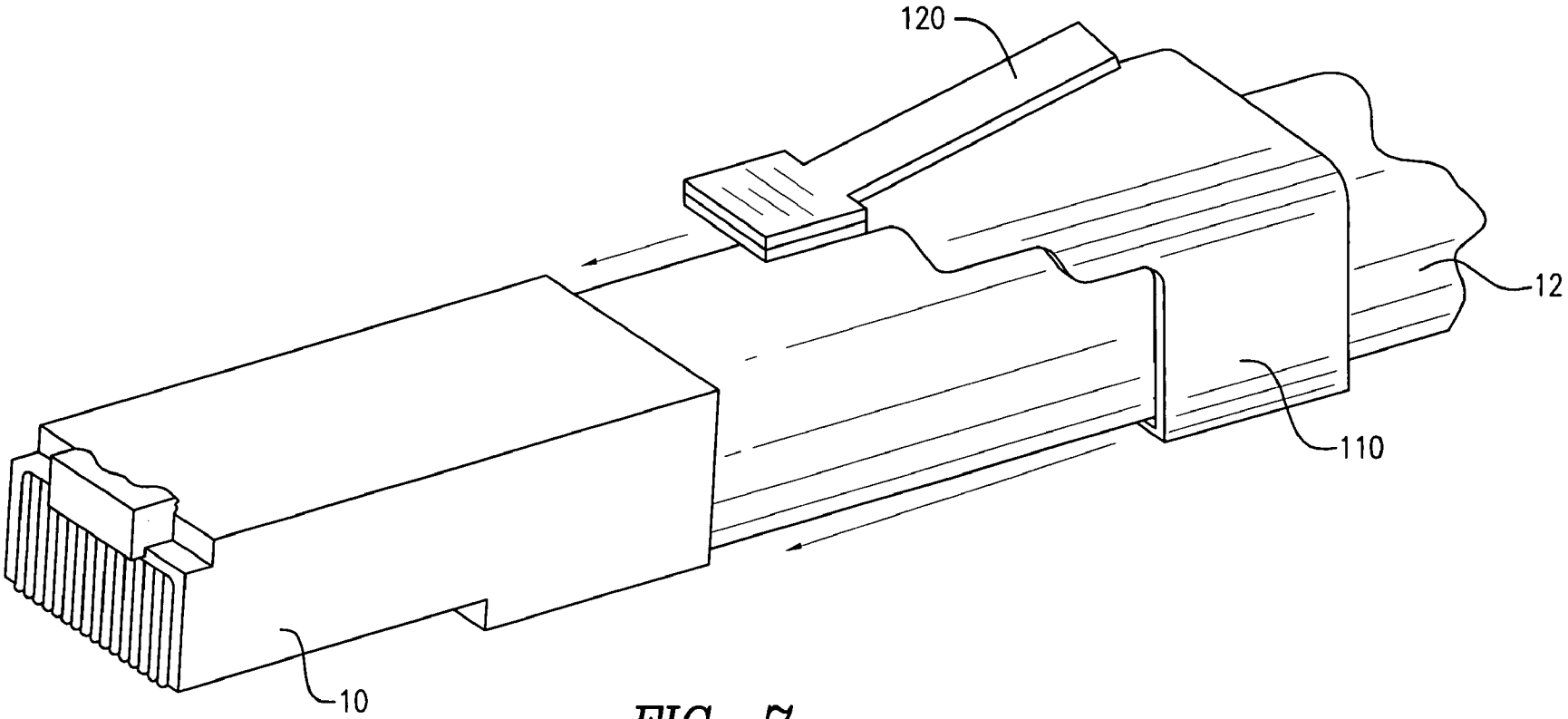
FIG. 7 is a perspective view of the present invention replacement tab and housing as it is being installed onto a prior art modular plug.
Figure 8:
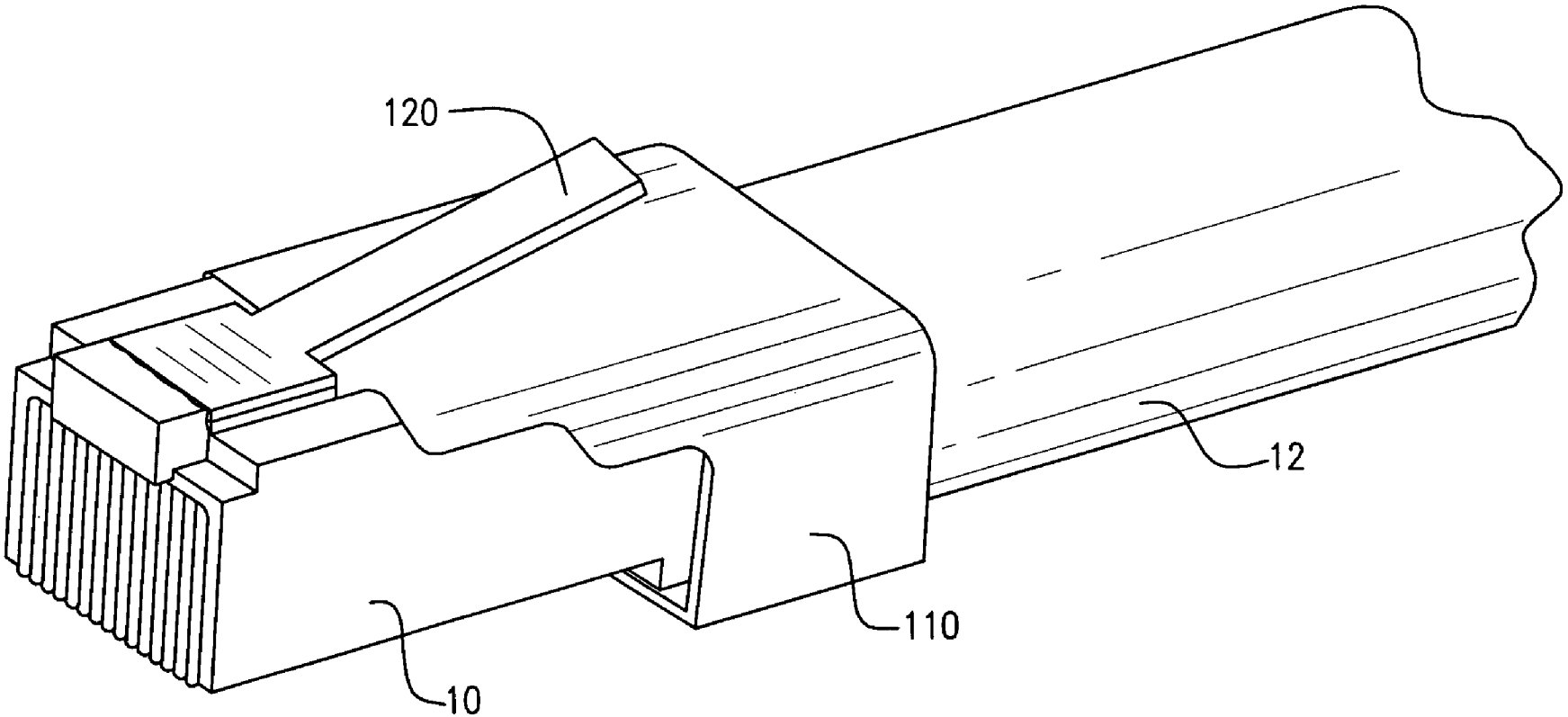
FIG. 8 is perspective view of the present invention replacement tab and housing shown installed onto a prior art modular plug.

The present invention is utilized in conjunction with an Ethernet plug or other such modular connector when its original depressible tab is broken off. As seen best in FIGS. 7 and 8, the replacement tab of the present invention is utilized in the following manner. Presented with a modular connector whose depressible tab has broken off, the user inserts the telecommunications cable 12 through the partially open bottom of the housing. As seen in FIG. 7, the housing is pushed forward over the modular plug having a broken-off depressible tab. Now, the replacement depressible tab of the present invention is in place in the same location as the missing tab, as best depicted in FIG. 8. At this point, the modular plug can be inserted into the telecommunications port in the usual manner.

As will be appreciated, utilization of the present invention replacement tab is a time-saving device. With prior art Ethernet connectors or other such modular plugs, once the depressible tab has broken off, the user needs to cut off the connector, strip the wire, and replace the original modular connector. Through use of the present invention, these steps are eliminated.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed:

1. A replacement tab for use on a modular telecommunications connector having a broken-off depressible tab comprising:

a housing, said housing sized and configured to fit over the modular telecommunications connector having a broken-off depressible tab, said housing having a top surface, a front edge, a back edge and two side walls extending downward from said top surface, said side walls being cut away in a stepped fashion toward the front edge of said housing thereby forming a top-wall tongue, said tongue sized and configured to fit into a female telecommunications port, and;

a replacement depressible tab flexibly attached to the top surface of said housing and extending angularly upward toward the back edge of said housing.

* * * * *